United States Patent [19]

Oda et al.

[11] Patent Number: 4,508,076

[45] Date of Patent: Apr. 2, 1985

[54] IDLING SPEEDING CONTROL SYSTEM FOR INTERNAL COMBUSTION ENGINE

[75] Inventors: Tatsuro Oda; Hideki Tanaka; Sadashichi Yoshioka; Katsuhiko Yokooku, all of Hiroshima, Japan

[73] Assignee: Mazda Motor Corporation, Japan

[21] Appl. No.: 522,220

[22] Filed: Aug. 11, 1983

[30] Foreign Application Priority Data

Aug. 16, 1982 [JP] Japan ..... 57-141979

[51] Int. Cl.[3] ..... F02M 3/00

[52] U.S. Cl. ..... 123/339

[58] Field of Search ..... 123/339, 586, 588, 585

[56] References Cited

U.S. PATENT DOCUMENTS

| | | | |
|---|---|---|---|
| 4,237,833 | 12/1980 | De Lauriers | 123/339 |
| 4,344,399 | 8/1982 | Matsumura et al. | 123/339 |
| 4,414,943 | 11/1983 | Nagase | 123/339 |
| 4,418,665 | 12/1983 | Nagase | 123/339 |

FOREIGN PATENT DOCUMENTS 156227 12/1980 Japan .

*Primary Examiner*—Parshotam S. Lall

*Attorney, Agent, or Firm*—Gerald J. Ferguson, Jr.; Joseph J. Baker

[57] ABSTRACT

The idling speed of an internal combustion engine is controlled by controlling the position of a control valve disposed in the intake system of the engine to control the amount of intake air fed to the engine. A desired idling speed is determined according to the operating condition of the engine and the control valve is moved to a temporary target position which is expected to be suitable to obtain the desired idling speed. Then feedback control is carried out to converge the actual idling speed to the desired idling speed. When the actual idling speed is finally equalized to the desired idling speed, the actual position of the control valve at that moment is detected and memorized to be adopted as the temporary target position for the same operating condition in later control of the idling speed.

7 Claims, 9 Drawing Figures

IDLING SPEEDING CONTROL SYSTEM FOR INTERNAL COMBUSTION ENGINE

BACKGROUND OF THE INVENTION

1. Field of the Invention

This invention relates to an idling speed control system for an internal combustion engine.

2. Description of the Prior Art

Generally it is preferred to maintain the idling speed of the internal combustion engine of a vehicle at a low speed of about 600 to 700 rpm from the viewpoint of fuel consumption and stability of the combustion in the engine. Thus, there have been known various idling speed control systems in which an actuator for controlling the opening angle of the throttle valve or the opening angle of a bypass valve in a passage bypassing the throttle valve is provided and the actuator is controlled according to the difference between the actual idling speed and a desired idling speed determined according to the operating conditions of the engine such as the temperature of the coolant and whether or not a cooler is in operation so that the actual idling speed is equalized to the desired idling speed.

In the conventional idling speed control systems, in order to improve response speed, the throttle valve or the bypass valve is first moved to a temporary position which is expected to be suitable to obtain the desired idling speed, and then feedback control is effected to finally converge the corrected actual idling speed, which has substantially approached the desired idling speed, to the desired idling speed. See Japanese Unexamined Patent Publication No. 55(1980)-156227, for example.

In the system in which the idling speed is controlled in the manner described above, the throttle valve or the bypass valve must be moved by a large amount to the temporary position when, for example, the cooler begins to operate during idling and the desired idling speed is changed. In order to limit fluctuation in the idling speed in such cases, it is naturally desired that it be possible for the actual idling speed to be equalized to the desired idling speed by one movement of the throttle valve or the bypass valve. Thus there has been proposed a method of controlling the idling speed in which the relationship between the position of the control valve (the throttle valve or the bypass valve) and the idling speed is stored in detail in a memory in advance and the control valve is driven to control the idling speed according to the relationship stored in the memory. However, this method is disadvantageous in that the actual idling speed cannot be always precisely equalized to the desired idling speed since the performance of the engine differs from engine to engine even in the same type engines due to manufactural differences, change with time and the like, and accordingly the idling speed may possibly fluctuate for a while.

SUMMARY OF THE INVENTION

In view of the foregoing observations and description, the primary object of the present invention is to provide an idling speed control system free from the problems described above.

The idling speed control system of the present invention comprises a rotational speed detecting means for generating a rotational speed signal representing the rotational speed of the engine, an operating condition detecting means for generating an operating condition signal representing the operating condition of the engine, a valve actuator which receives a valve driving signal and controls the position of said control valve, a desired idling speed determining means for determining a desired idling speed taking into account the operating condition of the engine represented by the operating condition signal fed thereto, a first value determining means which determines a first value according to the desired idling speed determined by the desired idling speed determining means, the first value being for moving said control valve to a temporary target position which is expected to be suitable to obtain the desired idling speed, a second value determining means which determines a second value according to the difference between the actual rotational speed of the engine represented by the rotational speed signal fed from the rotational speed detecting means and the desired idling speed determined by the desired idling speed determining means, the second value being for correcting the position of the control valve to a final target position so that the actual rotational speed converges to the desired idling speed, a driving signal generating means which generates the valve driving signal according to a third value which is derived from the first and second values respectively determined by the first value determining means and the second value determining means and feeds it to the valve actuator, and a first value correcting means which detects the third value at a time when the actual rotational speed of the engine is equalized to the desired idling speed and acts on the first value determining means so that the first value determining means adopts the third value at that time as the first value for the same desired idling speed in the following determining operations.

In one embodiment of the present invention the temporary target position of the control valve corresponding to a desired idling speed is determined in accordance with a known relationship between the idling speed and the opening angle of the control valve which is generally written as $$T=K\cdot N+X$$

wherein T is the opening angle of the control valve, K is the slope, N is the desired idling speed and X is the intercept. The slope K is a constant and the temporary target position for the desired idling speed is changed by changing the intercept X. The control valve is first moved to the temporary target position obtained from the above equation and then further moved to a final target position according to the difference between the desired idling speed and the actual idling speed after the control valve is moved to the temporary target position. In this embodiment, said first value corresponds to the intercept X and said second value is used to move the control valve from the temporary target position to the final target position. The intercept X is successively refreshed to give a temporary target position of the control valve which is equal to the final position of the control valve at the time when the idling speed is last converged to the idling speed for the same operating condition. Therefore the temporary target position determined for a certain operating condition of the engine is maintained, following the change of the characteristics of the engine, near the position in which the actual idling speed can be equalized to the desired idling speed, whereby fluctuation in the idling speed when the operating condition changes and the desired idling speed is changed can be prevented.

DESCRIPTION OF THE PREFERRED EMBODIMENT

Figure 1:
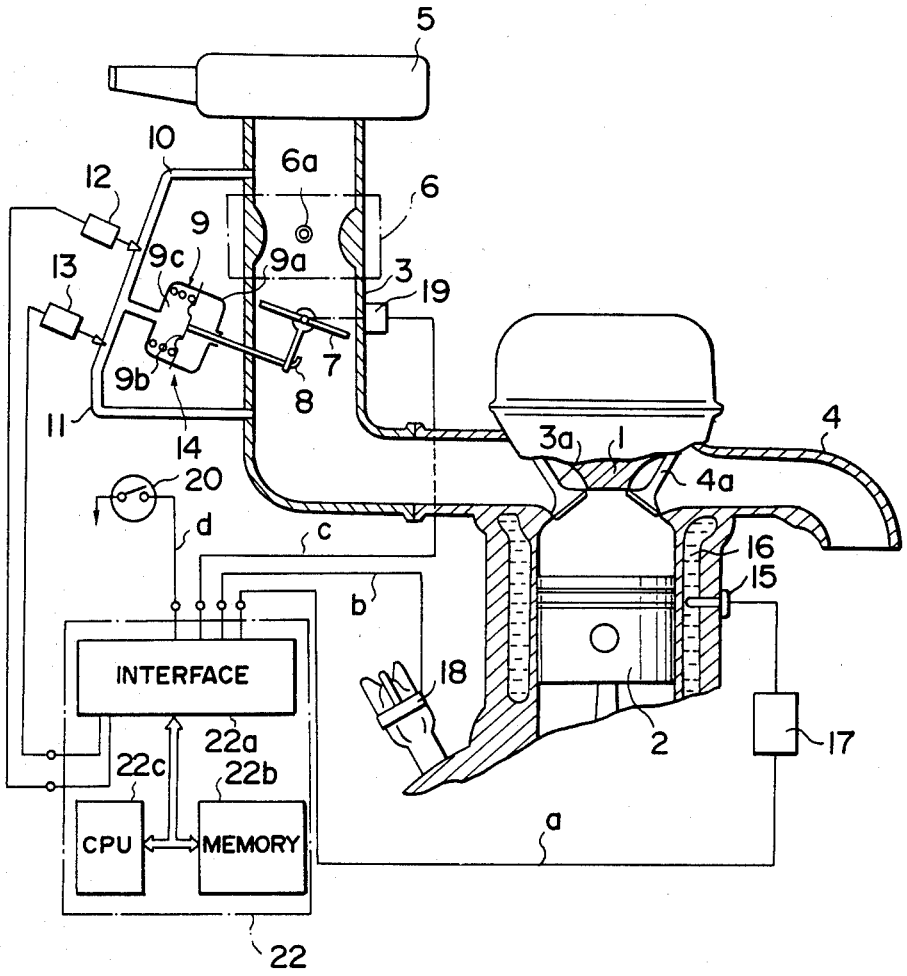
FIG. 1 is a schematic view of an internal combustion engine employing an idling speed control system in accordance with an embodiment of the present invention.

In FIG. 1 an internal combustion engine 1 has a piston 2, an intake manifold 3, an intake valve 3*a*, an exhaust manifold 4 and an exhaust valve 4*a*. On the top end of the intake manifold 3 is mounted an air cleaner 5 for filtering the air taken into the intake manifold 3, and a caburettor 6 is provided in the intake manifold 3 below the air cleaner 5. A fuel nozzle 6*a* of the caburettor 6 opens into the intake manifold 3. A throttle valve 7 is disposed just below or just downstream of the caburettor 6 to control the amount of air fed to the combustion engine 1. The throttle valve 7 is controlled by an actuator 14 including a stopper 8 which is engaged with the throttle valve 7 to open and close it. The stopper 8 is driven by a disphragm unit 9 comprising a casing 9*a* and a diaphragm 9*b* which is mounted in the casing 9*a* to divide the internal space thereof into two chambers, whereby a vacuum chamber 9*c* is formed on the side of the diaphragm 9*b* remote from the stopper 8. The stopper 8 is connected to the diaphragm 9*b* at its end remote from the throttle valve 7 to move together therewith. A first passage 10 connects the vacuum chamber 9*c* to the space in the intake manifold 3 upstream of the throttle valve 7 which is substantially at atmospheric pressure, while a second passage 11 connects the vacuum chamber 9*c* to the space in the induction manifold 3 downstream of the throttle valve 7 which is at a negative pressure. First and second solenoid valves 12 and 13 are provided to open and close the respective passages 10 and 11.

A coolant temperature sensor 15 detects the temperature of collant 16. The output of the sensor 15 is inputted into an A/D converter 17 which converts the analogue signal output of the sensor 16 into a digital signal. The output of the A/D converter 17, or a coolant temperature signal a is inputted into an interface 22*a* of an actuator controlling device 22 which will be described hereinbelow. A distributor 18 contains therein a rotational speed detector (an electromagnetic pick-up device) for detecting the rotational speed of the combustion engine 1 the output of which is inputted into the interface 22*a* of the actuator controlling device 22 as a rotational speed signal b. A throttle position sensor 19 detects the opening angle of the throttle valve 7 and delivers a throttle opening angle signal c to the interface 22*a*. A cooler load signal d which is the output of a cooler switch 20 is further inputted into the interface 22*a*.

The actuator controlling device 22 is in the form of a microcomputer comprising the interface 22*a*, a memory 22*b* and a CPU (Central Processing Unite) 22*c*, and compares the actual idling speed detected by the rotational speed detector with a desired idling speed which is determined according to the operating conditions of the engine 1 to determine a target opening angle of the throttle valve 7 according to the difference therebetween. At the same time, the actuator controlling device 22 compares the actual opening angle of the throttle valve 7 detected by the throttle position sensor 19 with the target opening angle of the valve 7 and controls the actuator 14 according to the difference therebetween so that the actual idling speed is equalized to the desired idling speed.

Figure 2:
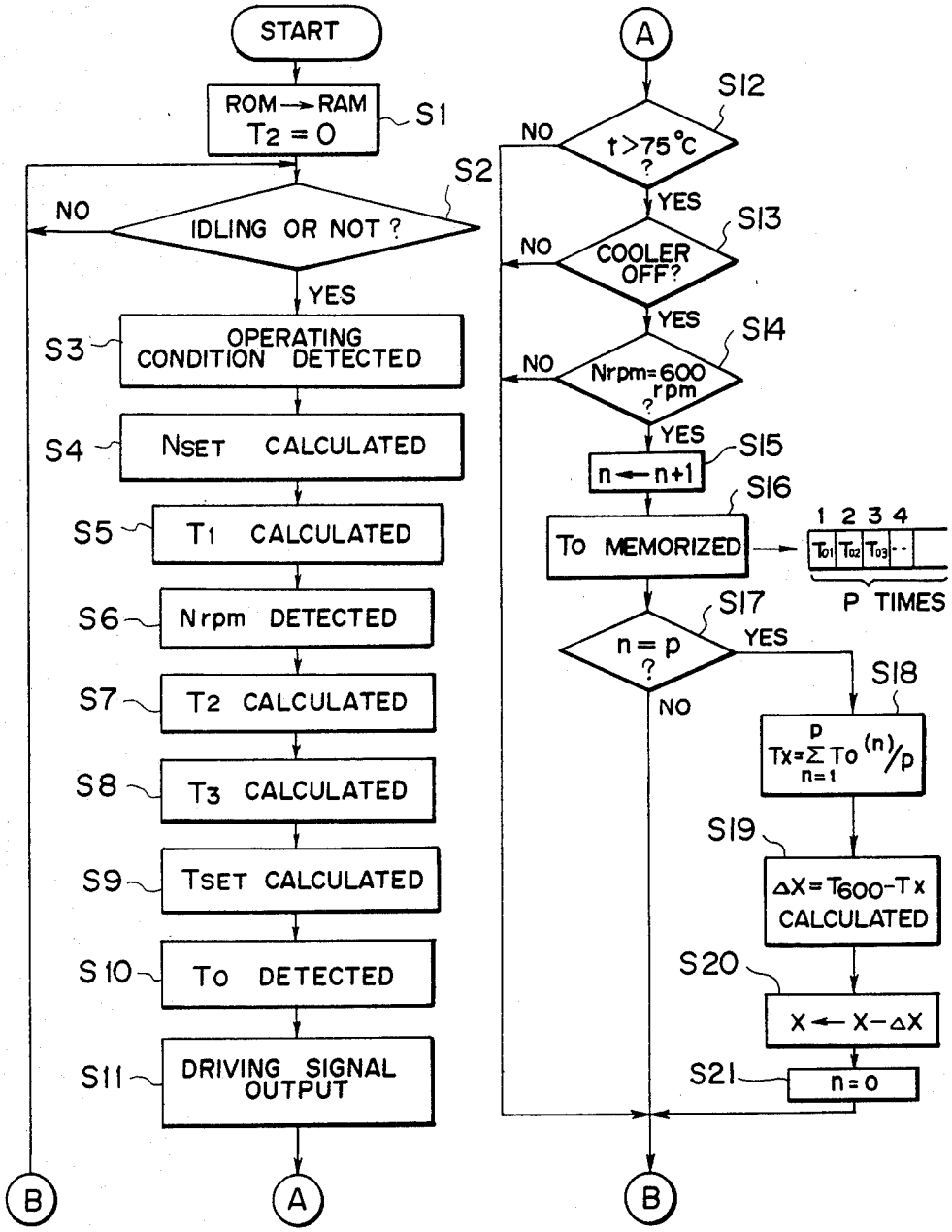
FIG. 2 is a flow chart of the CPU employed in the idling speed control system of FIG. 1.

Now, operation of the control system of FIG. 1 will be described referring to FIG. 2 which shows a flow chart of operation of the CPU 22*c*.

In step S1, the CPU 22*c* sets a first correction term T2 (to be described in detail hereinbelow) at 0 as an initial value, and at the same time transfers the value of an intercept X (to be described in detail hereinbelow) of the target opening angle of the throttle valve 7 stored in the ROM to the RAM. In step S2, the CPU 22*c* determines from the throttle opening angle signal c and the rotational speed signal b whether or not the engine is idling, wherein it is determined that the engine is idling when the throttle valve 7 is in the idling position and at the same time the actual rotational speed of the engine is lower than a predetermined value. If NO, i.e., the engine is not idling, the CPU 22*c* repeats the step S2 until the engine comes to idle. When it is determined that the engine is idling, the CPU 22*c* proceeds step S3. In the step S3, the CPU 22*c* detects the operating conditions of the engine by way of the cooler load signal d and the coolant temperature signal a. In step S4, the desired idling speed Nset is calculated according to the temperature of the coolant and whether or not the cooler is in operation in accordance with the relationship shown in FIG. 3. As can be seen from FIG. 3, when the temperature of the coolant is low, the desired idling speed Nset is set at a high value. This is because when the ambient temperature is low, idling cannot be stabilized unless the rotational speed of the engine is higher than a certain value. In the region where the temperature of the coolant is relationship high, when the cooler is in operation, the desired idling speed Nset is at a value higher than when the cooler is not in operation. This is to reduce vibration of the engine and to assure that the dynamo can generate sufficient electric current to operate the cooler.

Figure 4:
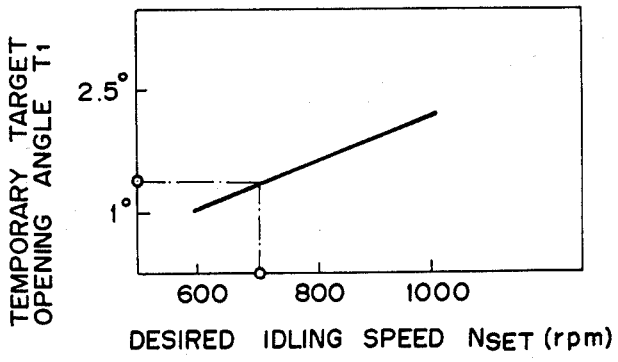
FIG. 4 is a graph showing the relationship between the temporary target opening angle of the throttle valve and the desired idling speed.
Figure 5:
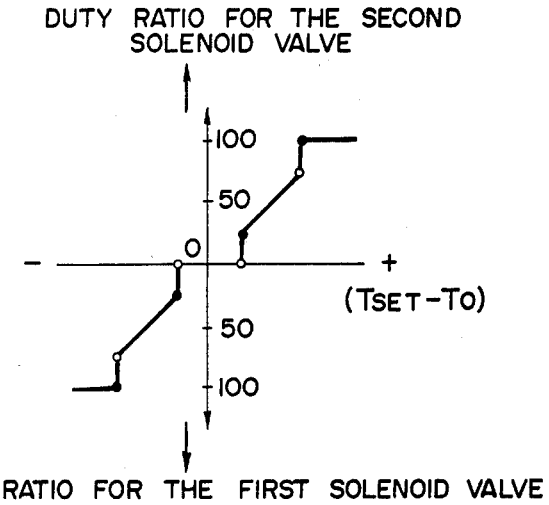
FIG. 5 is a graph showing the relationship between the duty ratio of the solenoid valve driving signal and the difference between the target opening angle of the throttle valve and the actual opening angle of the same.

In the next step S5, a temporary target opening angle T1 of the throttle valve 7 corresponding to the desired idling speed Nset is obtained in accordance with the relationship shown in FIG. 4. As can be seen from FIG. 4, the temporary target opening angle T1 of the throttle valve 7 is substantially a one-dimensional function of the desired idling speed Nset, the function being written as $$T1 = K1 \cdot \text{Nset} + X$$

wherein K1 is the slope and X is the intercept. In the step S5, the temporary target opening angle T1 is calculated using this equation. In step S6 the actual rotational speed Nrpm of the engine is detected through the rotational speed signal b. In step S7, the difference between the desired idling speed Nset and the actual rotational speed Nrpm is multiplied by a constant k to obtain the value of the first correction term T2 for the target opening angle Tset of the throttle valve 7, i.e., T2=k (Nset−Nrpm). When the CPU 22c has completed the entire flow chart of FIG. 2 more than once, the value of the previous first correction term is added to the value of the newly obtained first correction term, i.e., T2=k (Nset−Nrpm)+T2. Thus, in this case, the sum T2 of the newly obtained first correction term T2 and the previous correction term is used as the value of the first correction term. In step S8, the value of the second correction term T3 is calculated, and the temporary target opening angle T1, the value of the first correction term T2 and the value of the second correction term T3 are summed to obtain the target opening angle Tset in step S9. The second correction term T3 is to open the throttle valve 7 by a predetermined angle when a load such as the cooler begins to operate in order to compensate for a transient reduction of the rotational speed of the engine due to increased load. In step S10, the actual opening angle T0 of the throttle valve 7 is detected through the throttle opening angle signal c. Further, in step S11, the difference between the target opening angle Tset and the actual opening angle T0 is calculated and a pulse signal having a duty ratio which is determined in accordance with the relationship shown in FIG. 5 according to the difference is outputted as the driving signal for the solenoid valves 12 and 13 to control the amount of the intake air.

The opening angle of the throttle valve 7 or the idling speed is controlled by the feedback control described above. One of the important features of the present invention is that the intercept X in the equation $T1 = K1 \cdot \text{Nset} + X$ is successively refreshed to limit fluctuation in the idling speed when the temporary target opening angle T1 of the throttle valve 7 is changed. This point will be described in detail, hereinbelow.

Figure 3:
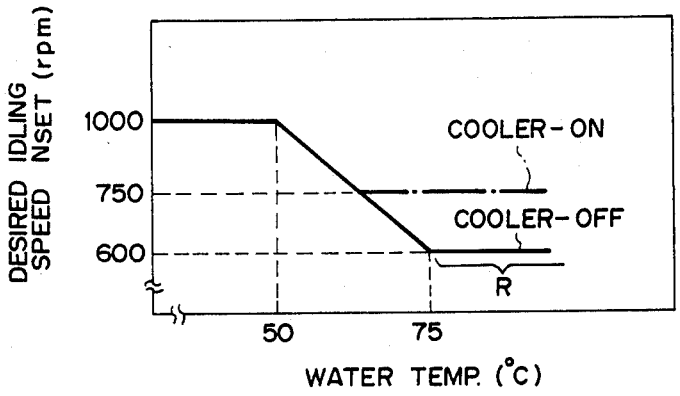
FIG. 3 is a graph showing the relationship between the temperature of the coolant and the desired idling speed in case of the embodiment of FIG. 1.
Figure 6:
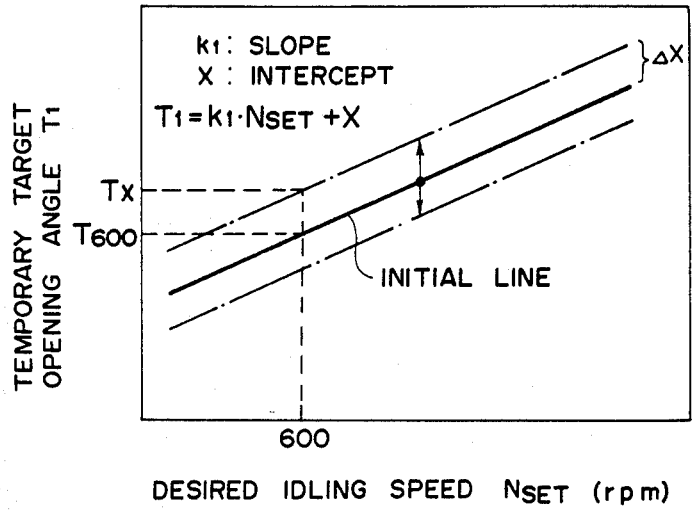
FIG. 6 is a graph illustrating the principle of operation of the idling speed control system of FIG. 1.

In steps S12 and S13 following the step S11, it is determined whether or not the operating condition is in a region in which the desired idling speed Nset is to be set at 600 rpm (the region indicated at R in FIG. 3). When it is determined that the operating condition of the engine is in the region R and at the same time it is determined that the rotational speed of the engine is correctly equalized to the desired idling speed Nset=600 rpm in step S14, the actual opening angle T0 of the throttle valve 7 at this time is sampled in step S16. The number n of the sampling is counted in step S15 prior to the sampling with an increasing n for each additional sample. The sampled actual opening angle T0 of the throttle valve 7 is stored in another RAM different from the one described previously. The sampling and storing of the actual opening angle T0 of the throttle valve 7 is repeated a predetermined number of times P (P>1) with the total number of the samplings being counted in step S17 and step S21 being an n reset for iterative operation. The average value Tx of the P pieces of data on the actual opening angle T0 of the throttle valve 7 is calculated in step S18. When the average value Tx differs from the temporary target opening angle T600 determined in the step S5 corresponding to the desired idling speed Nset=600 rpm, the intercept X must be corrected by the difference ΔX between Tx and T600 to precisely equalize the actual idling speed to the desired idling speed Nset which is 600 rpm in this case as can be seen from FIG. 6. Thus the difference ΔX between Tx and T600 is calculated in step S19, and the intercept X which was previously stored in the RAM and used in step S5 is replaced by the value obtained by correcting the previous intercept X by ΔX in step 20.

The corrected intercept X is used in the next step S5 for calculating the temporary target opening angle T1 of the throttle valve 7. Thus the throttle valve 7 can be moved to the position in which the desired idling speed Nset can be correctly obtained following the change of the state of the engine, and fluctuation in the idling speed due to the following feedback control can be suppressed.

When the operating condition of the engine is not in the region R in FIG. 3, said correction of the intercept X is not carried out and the operation of the CPU 22c is returned to the step S2 from the step S11. The reason why the determination whether or not the temporary target opening angle T1 precisely corresponds to the idling speed which is expected to be obtained at the opening angle T1 is carried out when the operating condition is in the region R is that the fluctuation in the idling speed N rpm is minimal in the region R. If desired, the determination may be carried out in several different regions to further improve the accuracy of the control. The reason why the average Tx of the actual opening angles T0 is used in the determination is to prevent error due to the fluctuation in the idling speed.

Although in the idling speed control system of the above embodiment, the idling speed is controlled by controlling the opening angle of the throttle valve, there has been known an idling speed control system in which a bypass valve disposed in a passage bypassing the throttle valve is controlled to control the idling speed. The present invention can also be applied to control systems of the latter type. Further in the above embodiment, both the rotational speed of the engine and the position of the throttle valve are fed back to control the idling speed. However, the present invention can also be applied to an idling speed control system in which only the rotational speed of the engine is fed back insofar as the control valve, e.g., the throttle valve or the bypass valve, is moved to the temporary target position corresponding to the desired idling speed in the system.

Further, the actuator for controlling the control valve need not be limited to one using the diaphragm unit but may be electrically driven one, for example.

Figure 7:
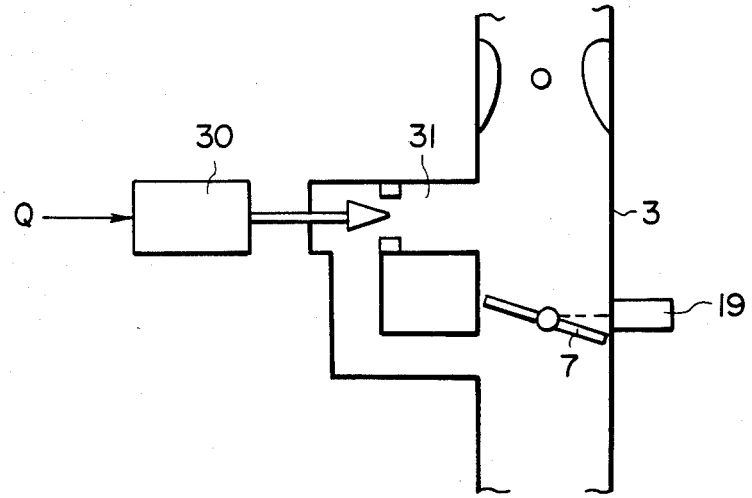
FIG. 7 is a fragmentary schematic view of an internal combustion engine employing an idling speed control system in accordance with another embodiment of the present invention.

In the embodiment shown in FIG. 7, the idling speed is controlled by controlling a bypass valve 30 in the form of a solenoid valve disposed in a passage 31 bypassing the throttle valve 7, and only the rotational speed of the engine is fed back to control the idling speed. The bypass valve 30 is controlled by a controlling device comprising a CPU and a memory similar to that in the embodiment shown in FIG. 1. The amount of intake air flowing through the passage 31 is controlled by controlling the voltage V imparted to the solenoid valve or bypass valve 30.

Figure 8:
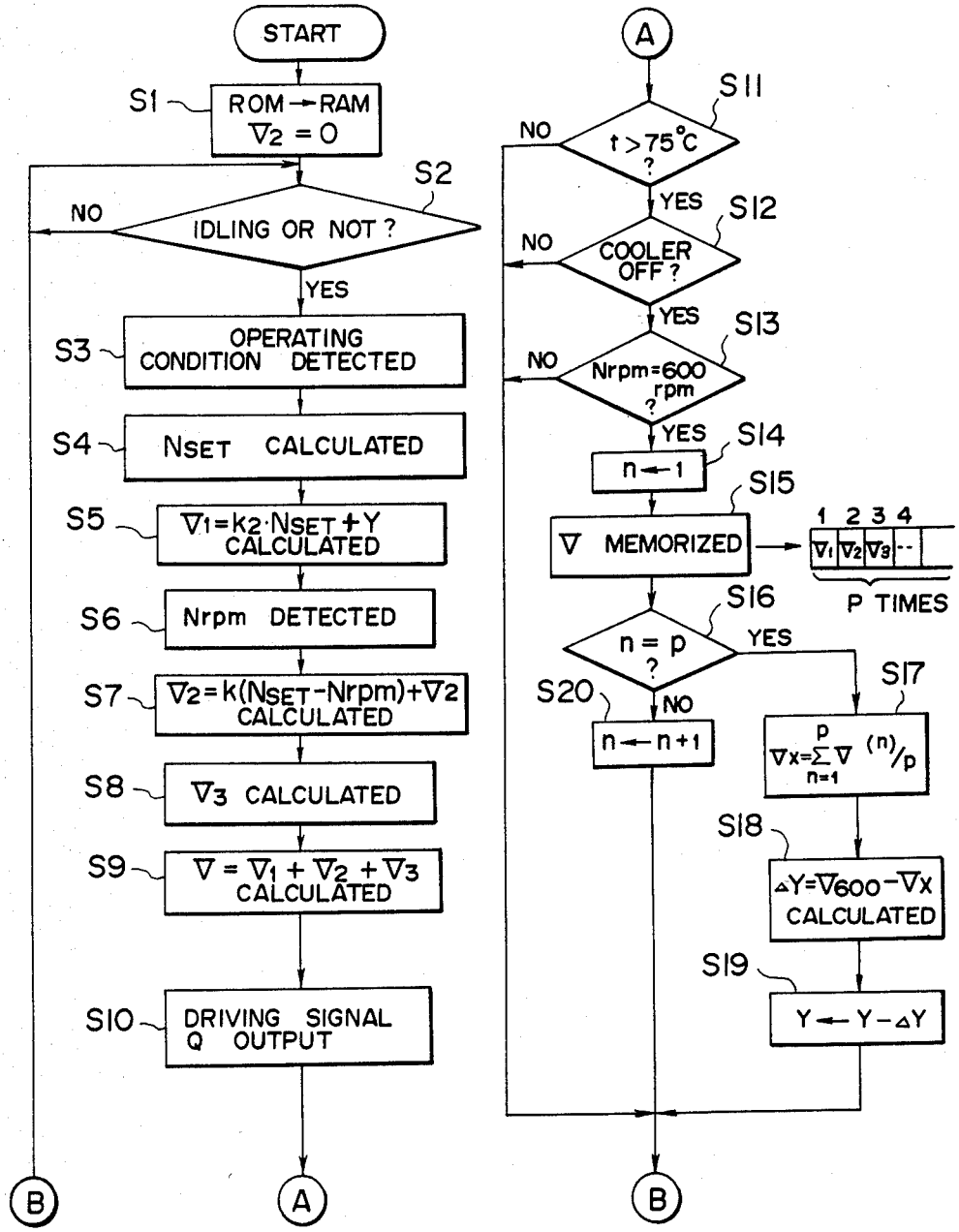
FIG. 8 is a flow chart of the CPU in the idling speed control system of FIG. 7.

The operation of the CPU in this embodiment is shown in FIG. 8.

In step S1, the CPU 22*c* sets a first correction term V2 at 0 as an initial value, and at the same time transfers the value of an intercept Y (to be described in detail hereinbelow) stored in the ROM to the RAM. In step S2, the CPU determines from the throttle opening angle signal c and the rotational speed signal b whether or not the engine is idling, wherein it is determined that the engine is idling when the throttle valve 7 is in the idling position and at the same time the actual rotational speed of the engine is lower than a predetermined value. If NO, i.e., the engine is not idling, the CPU repeats the step S2 until the engine comes to idle. When it is determined that the engine is idling, the CPU proceeds to step S3. In the step S3, the CPU 22*c* detects the operating conditions of the engine by way of the cooler load signal d and the coolant temperature signal a. In step S4, the desired idling speed Nset is calculated according to the temperature of the coolant and whether or not the cooler is in operation in accordance with the relationship shown in FIG. 3.

In the next step S5, a reference value V1 corresponding to the desired idling speed Nset is obtained. The reference value V1 is substantially a one-dimensional function of the desired idling speed Nset, the function being written as $$V1 = K2 \cdot \text{Nset} + Y$$

wherein K2 is the slope and Y is the intercept. In the step S5, the reference value V1 is calculated using this equation. In step S6 the actual rotational speed Nrpm of the engine is detected through the rotational speed signal b. In step S7, the difference between the desired idling speed Nset and the actual rotational speed Nrpm is multiplied by a constant k to obtain the value of the first correction term V2, i.e., V2=k (Nset−Nrpm). When the CPU has completed the entire flow chart of FIG. 8 more than once, the value of the previous first correction term is added to the value of the newly obtained first correction term, i.e., V2=k (Nset−Nrpm)+V2. Thus, in this case, the sum V2 of the newly obtained first correction term V2 and the previous correction term is used as the value of the first correction term. In step S8, the value of the second correction term V3 is calculated, and the reference value V1, the value of the first correction term V2 and the value of the second correction term V3 are summed to obtain a final value V in step S9. The second correction term V3 is to open the bypass valve 30 by a predetermined amount when a load such as the cooler begins to operate in order to compensate for a transient reduction of the rotational speed of the engine due to increased load.

In step S10, a control signal Q having a voltage corresponding to the final value V is outputted as the driving signal for the solenoid valve 30 to control the amount of intake air flowing through the bypass passage 31.

Figure 9:
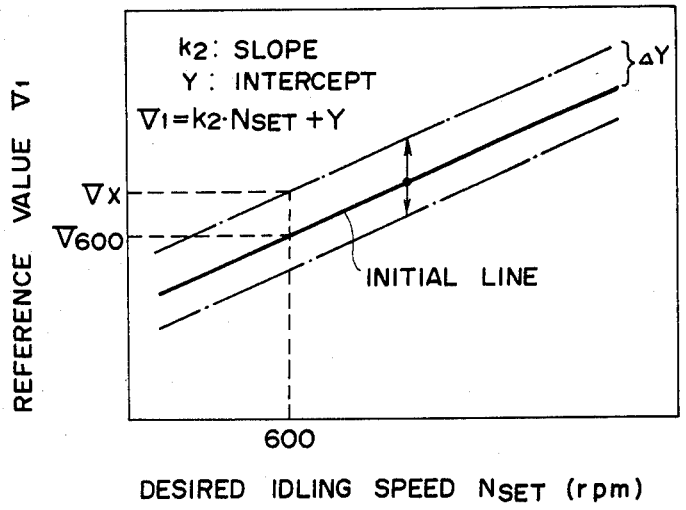
FIG. 9 is a graph illustrating the principle of operation of the idling speed control system of FIG. 7.

In steps S11 and S12 following the step S10, it is determined whether or not the operating condition is in a region in which the desired idling speed Nset is to be set at 600 rpm (the region indicated at R in FIG. 3). When it is determined that the operating condition of the engine is in the region R and at the same time it is determined that the rotational speed of the engine is correctly equalized to the desired idling speed Nset=600 rpm in step S13, the final value V for driving the bypass valve 30 at this time is sampled in step S15. The number n of the sampling is counted in step S14 prior to the sampling. The sampled final value V for driving the bypass valve 30 is stored in another RAM different from the one described previously. The sampling and storing of the final value V for driving the bypass valve 30 is repeated a predetermined number of times P (P>1) with the total number of the samplings being counted in steps S16 and S20. The average value Vx of the P pieces of data on the final value V for driving the bypass valve 30 is calculated in step S17. When the average value Vx differs from the value V600 corresponding to the reference value V1 which was determined in the step S5 corresponding to the desired idling speed Nset=600 rpm, the intercept Y must be corrected by the difference ΔY therebetween to precisely equalize the actual idling speed to the desired idling speed Nset which is 600 rpm in this case as can be seen from FIG. 9. Thus the difference ΔY is calculated in step S18, and the intercept Y which was previously stored in the RAM and used in step S5 is replaced by the value obtained by correcting the previous intercept Y by ΔY in step S19. The corrected intercept Y is used in the next step S5 for calculating reference value V1.

When the operating condition of the engine is not in the region R in FIG. 3, the operation of the CPU is returned to the step S2 from the step S10.

We claim:

1. An idling speed control system for an internal combustion engine having an intake system and a control valve disposed therein to control the amount of intake air fed to the engine, comprising a rotational speed detecting means for generating a rotational speed signal representing the rotational speed of the engine, an operating condition detecting means for generating an operating condition signal representing the operating condition of the engine, a valve actuator which receives a valve driving signal and controls the position of said control valve, a desired idling speed determining means for determining a desired idling speed taking into account the operating condition of the engine represented by the operating condition signal fed thereto, a first value determining means which determines a first value according to the desired idling speed determined by the desired idling speed determining means, the first value being for moving said control valve to a temporary target position which is expected to be suitable to obtain the desired idling speed, a second value determining means which determines a second value according to the difference between the actual rotational speed of the engine represented by the rotational speed signal fed from the rotational speed detecting means and the desired idling speed determined by the desired idling speed determining means, the second value being for correcting the position of the control valve to a final target position so that the actual rotational speed converges to the desired idling speed, a driving signal generating means which generates the valve driving signal according to a third value which is derived from the first and second values respectively determined by the first value determining means and the second value determining means and feeds it to the valve actuator, a first detecting means which detects that the actual rotational speed of the engine is equalized to the desired idling speed and generates a detecting signal;

a second detecting means which detects said third value at the moment when the first detecting means generates the detecting signal, an averaging means for averaging a plurality of values detected by the second detecting means, and a value correcting means which acts on the first value determining means to cause it to adopt the averaged value obtained by the averaging means as the first value.

2. An idling speed control system as defined in claim 1 further comprising a warm-up detecting means for detecting completion of engine warm-up and an actuating means which actuates the first and second detecting means upon completion of engine warm-up.

3. An idling speed control system as defined in claim 1 in which said second detecting means detects the third value for a plurality of desired idling speeds determined for different operating conditions to correct the first value to be adopted for each operating condition.

4. An idling speed control system as defined in claim 1 further comprising a valve position detecting means for detecting the position of the control valve in which said driving signal generating means generates said valve driving signal taking into account the difference between said final target position of the control valve and the actual position of the same detected by the valve position detecting means.

5. An idling speed control system as defined in claim 4, wherein said second detecting means detects said third value by way of the actual position of the control valve detected by said valve position detecting means at a time when the first detecting means generates the detecting signal.

6. An idling speed control system as defined in claim 5 in which said second detecting means detects the third value for a plurality of desired idling speeds determined for different operating conditions to correct the first value to be adopted for each operating conditions.

7. An idling speed control system as defined in claim 5 further comprising a warm-up detecting means for detecting completion of engine warm-up and an actuating means which actuates the first and second detecting means upon completion of engine warm-up.

* * * * *